United States Patent [19]

Reil

[11] 4,243,160

[45] Jan. 6, 1981

[54] DEVICE FOR FILLING A MEASURED QUANTITY OF A FLOWING MEDIUM INTO A PACKAGE

[75] Inventor: Wilhelm Reil, Bensheim-Auerbach, Fed. Rep. of Germany

[73] Assignee: Tetra Pack Developpement SA, Switzerland

[21] Appl. No.: 925,175

[22] Filed: Jul. 17, 1978

[30] Foreign Application Priority Data

Jul. 29, 1977 [DE] Fed. Rep. of Germany ..... 2734251

[51] Int. Cl.[3] ..... G01F 11/08

[52] U.S. Cl. ..... 222/373; 222/207; 222/214

[58] Field of Search ..... 222/373, 386.5, 389, 222/334, 207, 214; 417/394, 395, 474

[56] References Cited

U.S. PATENT DOCUMENTS

| | | | |
|---|---|---|---|
| 2,698,703 | 1/1955 | Harvey | 222/386.5 X |
| 3,062,153 | 11/1962 | Losey | 417/394 |
| 3,253,549 | 5/1966 | Vincent et al. | 417/394 X |
| 3,388,832 | 6/1968 | Stewart et al. | 222/386.5 X |
| 3,568,733 | 3/1971 | Lau | 222/207 X |
| 3,757,832 | 9/1973 | Waxlax | 141/59 |
| 3,862,708 | 1/1975 | Waxlax | 222/444 |
| 4,106,533 | 8/1978 | Herzig | 222/386.5 X |

*Primary Examiner*—F. J. Bartuska
*Attorney, Agent, or Firm*—Biebel, French & Nauman

[57] ABSTRACT

A device for filling an exact quantity of a fluid into packages includes a tubular housing with inlet and outlet fittings on its ends formed with inlet and outlet valve seats. A flexible tubular sheath extends within the housing clamped in sealed relation at its opposite ends to the housing by the fittings. Inlet and outlet valves cooperate with the valve seats to admit fluid into the sheath, to discharge fluid from the sheath, and to prevent flow of fluid medium in reverse direction. A supporting body is located within the sheath and defines with the sheath at least one chamber of precise volume. The interior of the housing exposed to the sheath and the exterior of the body are substantially equal in surface area, and the exterior surface of the body has a plurality of lengthwise extending channels which cooperate with the interior of the sheath to define the chamber. An opening extends through the housing to the exterior of the sheath, and gas under pressure can enter through the opening to force the sheath against the body to expel fluid from the chamber through the outlet valve. Flexible hoses are used to supply fluid to the inlet and to supply compressed gas to the opening, allowing limited movement of the entire device.

3 Claims, 3 Drawing Figures

DEVICE FOR FILLING A MEASURED QUANTITY OF A FLOWING MEDIUM INTO A PACKAGE

BACKGROUND OF THE INVENTION

The invention relates to a device for filling a specific quantity of a flowing medium into packages, with a pump device, packings or seals, and connections for loading and discharging the flowing medium.

There are known bottling devices for liquids (juices or milk, for example) which fill open top packages which are guided on a conveyor belt. The packages of a series have a specific volume, and therefore a filling device is provided which, in assembly-line fashion, fills the correct quantity of liquid as accurately as possible. Also, to some extent, hose pumps are used, in which rollers secured to arms revolving in a circle, squeeze a hose laid along the circumference of this circle, in such a manner that the hose is pressed together with the roller at the point of engagement, and consequently the liquid is pushed ahead. Other filling devices with piston pumps, sometimes called piston fillers, are known, in which the predetermined quantity of liquid is determined by the piston stroke or by the volume of the cylinder. Such machines are designed suitably for universal purpose, such that even the aseptic filling of liquids like milk, for example, is possible. Therefore the filling devices have units which can be sterilized, but have the drawback that they are difficult to clean. Especially, the filling devices have to be partially dismantled, otherwise it cannot be assured with safety that the aseptic cleansing fluid flows around all parts as it is flowing through during cleansing, and cleanses sufficiently that rigid sanitary conditions are complied with.

A further drawback of known machines resides in the immobility of the filling device. The mechanical control devices for the cylinders of the piston fillers prevent mobility of these known filling devices, particularly assembly-line fashion up and down movement during operation.

This oscillating movement, with an amplitude of 20 cm. for example, is especially necessary in the bottling of milk, in order to avoid the formation of foam. In the bottling of milk, also frequently in the case of juices, it is often necessary to insert the outflow tube or pipe of the filling device partially into the package to be filled, and to draw the tube out upwardly as the degree of filling increases. In this way the aperture of the outflow tube can always be held below the level of the liquid, whereby the formation of foam is significantly diminished. The oscillating up and down movement of the outflow tube on the filling device can be attained either by moving the entire filling device up and down, or by moving the package itself up and down with relation to the filling device.

At present, a great many liquids and pastes are filled into so-called "soft packages" like those which have found wide distribution in recent years for milk, for example. These "soft packages" have no solid surfaces for mechanical support for up and down movement of the package. The result is an unstable movement, which leads to great difficulty. On the other hand, if it is desired to assure the up and down movement of the filling device, the mechanical controls do not accommodate this. In the case of piston fillers, the piston must be mounted on a stationary device and precisely controlled. In the case of hose pumps, a control is necessary for the mechanical drive of the above-described arms or other rotating parts.

Thus it is recognized that the automatic filling of flow media (liquids or pastes, for example) in accurate amounts is very difficult.

Therefore, the problem forming the basis of the invention is to create a measuring device for filling liquids or pastes into containers or packages with precisely specified volumes, which device has a simple pump drive and is freely movable with relation to the stationary machine frame.

SUMMARY OF THE INVENTION

According to the invention, this problem is solved by arranging in a rigid hollow housing, at the inlet and outlet of which are control valves, an internal support body, and an elastic sheath or casing, which can be displaced against the internal wall of the housing or against the supporting body; and by arranging gas-introducing apertures in the housing. The surprising feature of this novel filling device resides in the feasibility of pumping with the tubular elastic sheath or casing, made of flexible material such as rubber or plastic. This sheath normally lies against the internal surface of the housing when flowing medium has been or is flowing in, until the volume of flowing medium specifically defined by the housing has been completely filled. Then, through the gas inlet apertures in the housing, a gas (such as air) under pressure can be introduced between the housing and the sheath in such manner that the sheath, as a result of its elasticity, finally rests against the external surface of the supporting body when the flowing medium has been pressed out. It will be recognized that the space between the supporting body and the housing is, so to say, the "stroke volume", which determines the pumped volume. The advantage of this novel filling device resides on one hand in its free mobilility, because no mechanical driving devices are required for pumping, and, on the other hand, in its good characteristics for being cleansed, because, in the cleaning process all parts which come into contact with the flowing medium are likewise contacted by the aseptic cleansing fluid. With the novel device, it is possible to move the packages on a conveyor, under the filling device, without oscillating up and down movement. On the other hand, introduction of the outflow tube of the filling device into the package is made possible by the fact that the filling device itself can be moved up and down in any preferred rhythm as a result of its good mobility.

Another advantageous feature of the invention resides in use of a tubular housing having at both ends tubular fittings which can be closed off by a packing or seal, against which the ends of the sheath, formed like a hose, rest and are sealed to the circumference of the ends of the fittings. The internal supporting body, defining longitudinally extending channels in the housing tube, is centrally located in the tube. In this preferred embodiment of the invention, the practical production possibilities of a housing built up of a tube with suitable end seal calkings is apparent. A particularly preferred structural solution for the supporting body is a configuration that in cross-section has three arms displaced about 120 degrees with relation to each other, with the point of connection (e.g. center of the body) arranged in the center of the supporting body and thereby also in the center of the tube, so that the mounting of the supporting body, being externally centered by its arms on the internal wall of the sheath, is simplified.

According to the invention, the control valves are suitably designed as flexibly mounted (or spring suspended) cones, and are movably disposed in head-pieces detachably secured as part of the tube end fittings, and having an annular sealing seat. Pre-stressing of these valve cones can be achieved by coil springs which act between support members and the valve cones. Compression of these springs is accomplished advantageously by means of the inflowing fluid at the intake, and the gas-pressured fluid at the outlet, so that mechanical parts which have to be secured on a stationary frame are not required. Desired elasticity of the valve cones could also be achieved by means of cup springs disposed respectively in proximity to a given cone.

Another advantage of the invention is that the external diameter of the internal supporting body is of the same size as the internal surface of the housing tube, allowing clearance for the sheath. In this way, accurate adjustment of the dispensed volume can be particularly well controlled. The elastic sheath, formed as a hose, in its condition after the flowing medium has been forced out, is pressed fully and completely on the external surface of the supporting body, but lies against the internal surface of the tube after the gas pressure has been released and immediately before filling, as well as after filling the desired volume of the fluid. The volume can thus be calculated precisely, and suitably-dimensioned sheathing bodies can be provided, or the flexibility of the sheath hose can be suitably adjusted.

A preferred embodiment of the invention provides that the valve cones be disposed concentric to the longitudinal axis of the tube, be held by a valve stem (or rod) provided in a central aperture in the supporting body, and each be pre-stressed to loaded to closed position by a spring. In this embodiment, the valve rod or stem goes from above the intake end of the housing tube through the upper valve cone, through the centrally-disposed supporting body, to the outlet valve cone, to which the end of the rod is connected. In this way, it is possible to arrange both springs for pre-stressing the valve cones at the upper or intake fitting, for example.

A further advantage of the invention is that, a hose can be provided at the gas-introducing apertures for connection to a compressor, and another can be provided on at least the inlet fitting end of the housing tube for connection to a supply of the flowing medium. The outstanding mobility of the filling device according to the invention becomes particularly clear by reason of these hose connections. Since no rigid connections to stationary parts are required, but, rather, the pumping energy for pumping the flowing medium in desired quantities through the hose is supplied in the form of a compressed gas, and the flowing medium itself is supplied by pressure through optional movable hoses, the pumping/metering device can be moved over large extents without difficulties of the kind initially mentioned.

Also, precise determination of air pressure for the pumping movement of the sheath is not important; it is only necessary to provide sufficient gas pressure for forcing the flowing medium out such that the spring which presses the outlet valve cone against its seat can be overcome. The force of the spring provided at the intake end of the tube housing for seating the intake valve on its seat should be suitably arranged that it is less than the supply pressure prevailing in the supply of flowing medium to be packaged. Then, by opening a valve in the supplying conduit to the filling device of the invention, sufficient force is built up by the supply pressure that the intake valve cone is lifted open, and the volume within the housing can be filled in the desired manner.

Further advantages, features, and possibilities of application of the instant invention will be apparent from the following description, in connection with the drawings.

DESCRIPTION OF THE PREFERRED EMBODIMENT

Figure 1:
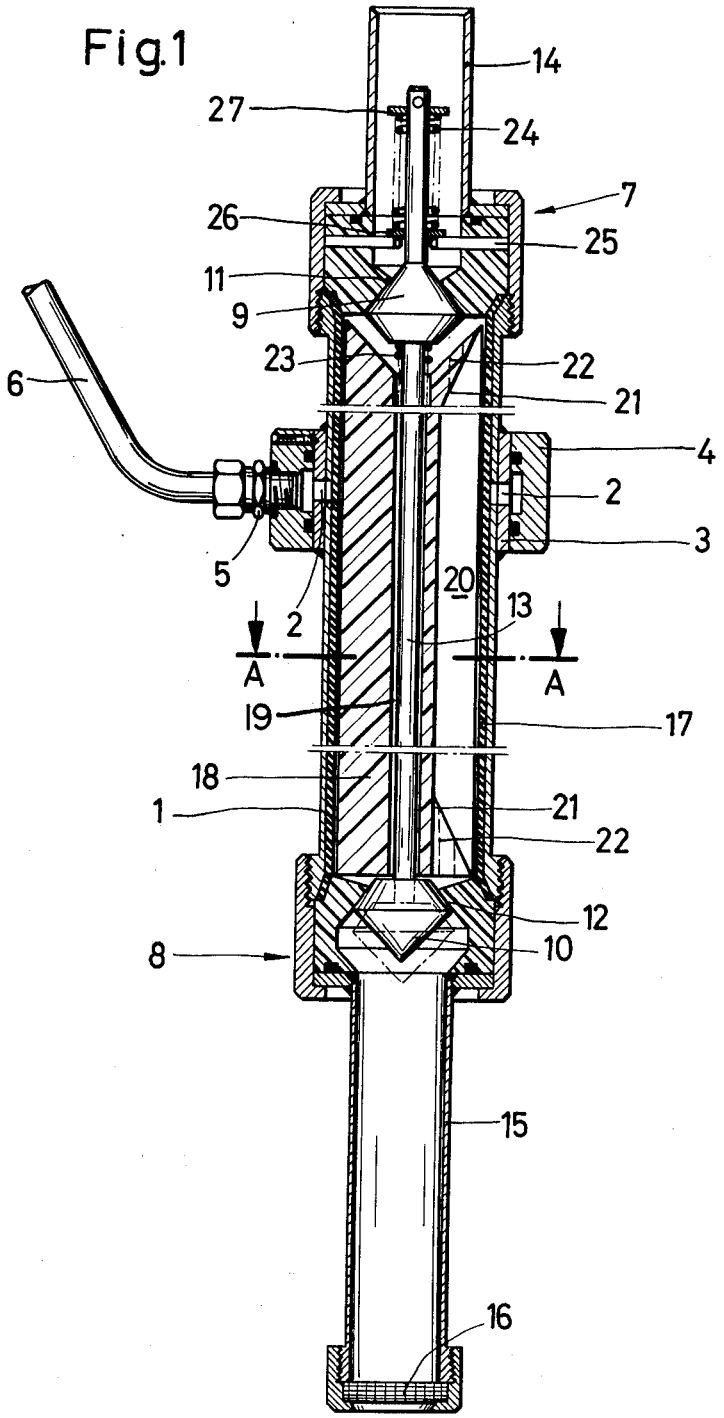
FIG. 1 shows a partly broken away cross-sectional view through the filling device of the invention.

The embodiment described in the following description serves for filling a specific quantity of milk into soft packages. The milk supply line (to be imagined as arranged in the upper portion of FIG. 1) and the soft packages (to be imagined as arranged in the lower portion of FIG. 1) are not shown. The housing of the device consists of a rigid tube 1, which is shown separately in FIG. 2 in order to permit perception of the gas intake apertures 2 and the collar 3, which is welded to the tube 1. A connecting ring 4 is laid, fluid-tight, around this collar 3 in order consequently to provide the connection for a gas intake nipple 5, which is secured to the forward end of a hose 6 and, by means of the latter, is connected to a gas pump or compressor, not represented. In the embodiment disclosed, the pump is an air compressor.

The upper, or supplying, end of the tube 1 is closed by a headpiece or fitting 7, and the lower or outflow end of the tube 1 is closed by a headpiece 8, each sealed. At the upper end, a valve cone 9, and at the lower end a valve cone 10, are spring-forced against cone-seating surfaces 11 and 12. Both valve cones 9 and 10 are supported on a valve rod 13, which extends through the upper valve cone 9 into a filling socket 14, which is welded to the upper headpiece 7, while to the lower headpiece is connected an outflow socket 15, at whose lower end, preferably, screen inserts 16 can be disposed for avoiding the formation of foam.

Figure 2:
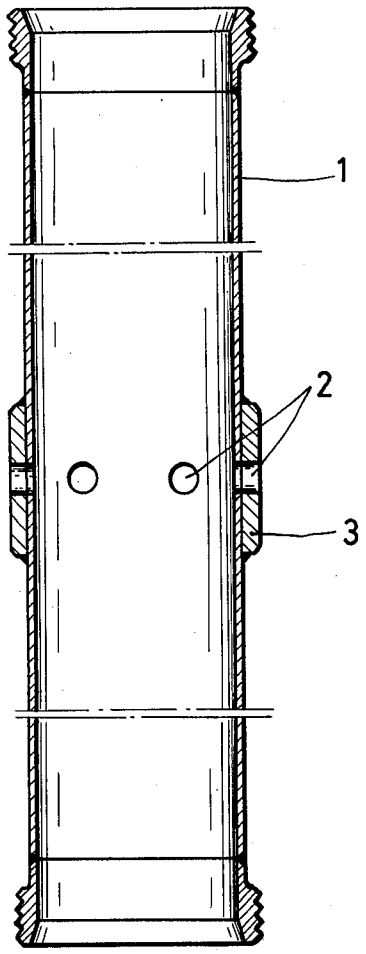
FIG. 2 shows a sectional view, broken away and shortened, through the tube housing and the gas intake apertures
Figure 3:
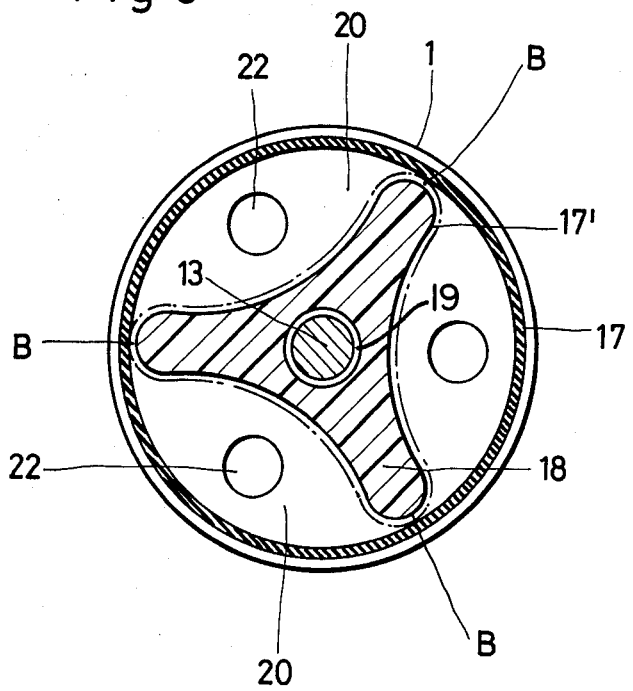
FIG. 3 shows a cross-sectional view through the device according to FIG. 1 along a plane shown by the line A—A.

At the upper end as well as at the lower end of the tube 1, around the circumference, there is secured and sealed the respective ends of a flexible hose or sheath 17, which is shown laid internally against the surface of the tube 1, as shown by the solid lines in FIGS. 1 and 3. In FIG. 3, another position of the hose 17 is shown in dot and dash lines 17'. That is, laying against the external surface of the supporting body 18, centrally disposed in the tube 1, as a result of pressure of the air pumped in through the apertures 2. The supporting body 18, which, like the other tubes, nipples, supports, headpiece, and the like, can be manufactured from steel, preferably stainless (or non-rusting) steel, has a cross-section with three arms, displaced by 120 degrees with relation to one another, whose outer ends lie along the entire hose 17 at the points B. In the center is situated a longitudinal aperture 19, which extends lengthwise of the tube 1, just like the channels 20 formed by the shape of the supporting body 18.

In FIGS. 1 and 3, diagonal transition surfaces 21 with axial borings 22 can be seen. The surfaces 21 provide for transition from the supporting body 18 to the sealing edge at the outer ends of the hose 17. Through the apertures 22, the fluid can be pressed out downwardly into the outflow socket 15.

The control valves are formed as cones 9 and 10. The upper valve cone 9 is situated on the intake or filling end of the filling device. It is slidable on the valve rod 13, and is forced or seated against the supporting body 18 by means of the spring 23. The lower valve cone 10 is seated by the spiral spring 24, which acts at one end on an abutment ring disk 26, supported by guide pins 25, and at its other end against a ring disk 27 on rod 13.

In operation, the filling device according to the invention operates as follows:

The milk is filled into the upper headpiece 7 through a hose (not shown) either clamped or vulcanized to the filling socket 14. The supply pressure of the milk is great enough to overcome the relatively weak force of the spring 23 and thus to move the upper valve cone 9 from its seat 11. Immediately before filling begins, the rubber hose or sheath 17 is situated as indicated by solid lines in FIGS. 1 and 3; that is, it lies against the inner surface of the tube 1. The milk flows past the upper valve cone 9, through the upper apertures 22 in the transition surfaces 21, through the axial channels 20, and stops at the lower valve cone 10, shown in solid lines and sealed against the seat 12 by the tension of the spring 24.

In this manner, the entire volume inside the tube 1; that is, the sum of the three volumes formed by the channels 20; is filled with milk until the upper valve cone 9 returns to its seat 11 for lack of pressure difference. Then, by means of switching devices (not shown), the air compressor advances compressed air through the hose 6 and the gas-introducing apertures 2 between the tube 1 and the hose 17, so that now an excess pressure exists within the volume, which on one hand forces the upper valve cone 9 firmly against its seat 11 and on the other hand, after a desired pressure level has been exceeded, overcomes the force of the stronger spring 24 and lifts the lower valve cone 10 off of its seat 12. At that instant, filling of the milk into the package situated therebeneath (not shown) begins, the filling device being able to be moved downwardly and upwardly in its totality. When the milk has been filled into the package, the sheath 17 moves out of the position shown in solid lines in FIGS. 1 and 3 into the position shown by dot dash lines in FIG. 3; that is, the hose lies against the external surface of the supporting body 18. This is particularly possible when the external surface of the supporting body 18 is of the same size as the internal surface of the tube 1. The package is now filled with the desired quantity of milk, the upper spring 24 detects no counter-pressure, and in addition, the compressor cuts off, and the lower valve cone 10 is seated again on its seat 12. The hose 17 moves out of the position shown in dot dash lines in FIG. 3 into the original position on the internal surface of the tube 1. The above described procedure can now begin anew to fill the next package, which is moved under the filling device by means of a conveyor, not represented.

What is claimed is:

1. A device for filling a specified quantity of a flowing medium into packages from a supply of the medium; characterized by a tubular housing, inlet and outlet fittings on the ends of said housing providing inlet and outlet valve seats, a flexible tubular sheath within said housing and clamped in sealed relation at its opposite ends to said housing by said fittings, inlet and outlet valves cooperating with said valve seats and arranged to admit the medium into said sheath and to permit discharge of the medium from said sheath and to prevent flow of the medium in the reverse direction, a supporting body within said sheath located between said valves and defining with said sheath at least one chamber of precise volume, the interior of said housing exposed to said sheath and the exterior of said supporting body being substantially equal in surface area, a rod extending through said body and mounting said inlet and outlet valves, said sheath together with said body and said valve seats defining a passageway through said device essentially without crevices and thereby capable of complete cleansing by flowing a cleansing fluid therethrough, an opening through said housing to the exterior of said sheath, means for selectively supplying gas under pressure through said opening to force said sheath against said supporting body whereby to expel the medium from said chamber through said outlet valve, and flexible hoses connected to supply medium to said inlet and to supply compressed gas to said opening and thereby allowing limited movement of the device.

2. A device as defined in claim 1, wherein the exterior surface area of said supporting body is shaped to define a plurality of lengthwise extending channels which cooperate with the interior of said sheath to define said chamber.

3. A device as defined in claims 1 or 2, wherein said inlet valve is constructed to open and admit medium to said chamber in repose to pressure of medium pumped to said inlet, said outlet valve is constructed to resist opening in response to the pressure of the pumped medium and to open upon exertion of a higher pressure due to supply of compressed gas against the exterior of said sheath.

* * * * *